United States Patent [19]

Conzemius

[11] Patent Number: 4,894,536

[45] Date of Patent: Jan. 16, 1990

[54] SINGLE EVENT MASS SPECTROMETRY

[75] Inventor: Robert J. Conzemius, Ames, Iowa

[73] Assignee: Iowa State University Research Foundation, Inc., Ames, Iowa

[21] Appl. No.: 124,023

[22] Filed: Nov. 23, 1987

[51] Int. Cl.[4] ..... H01J 49/26

[52] U.S. Cl. ..... 250/287; 250/288; 250/282

[58] Field of Search ..... 250/287, 288, 281, 282

[56] References Cited

U.S. PATENT DOCUMENTS

| | | | |
|---|---|---|---|
| 4,072,862 | 2/1978 | Mamyrin et al. | 250/286 |
| 4,136,280 | 1/1979 | Hunt et al. | 250/292 |
| 4,296,322 | 10/1981 | Wechsung | 250/287 |
| 4,439,395 | 3/1984 | Kim | 376/130 |
| 4,458,149 | 7/1984 | Muga | 250/287 |
| 4,472,631 | 9/1984 | Enke et al. | 250/287 |
| 4,611,118 | 9/1986 | Managadze | 250/287 |
| 4,686,366 | 8/1987 | Stuke | 250/287 |
| 4,694,168 | 9/1987 | Beyec et al. | 250/287 |
| 4,733,073 | 3/1988 | Becker et al. | 250/287 |

FOREIGN PATENT DOCUMENTS

| | | |
|---|---|---|
| 59-173938 | 10/1984 | Japan . |
| 1105962 | 7/1984 | U.S.S.R. . |

OTHER PUBLICATIONS

Hunt, W. W. Jr., Huffman, R. E., and McGee, K. E., "Observation and Identification of Ion . . . ", Rev. Sci. Instr., vol. 35, 1964, pp. 82–88.

Hunt et al., "Time-of-Flight Mass Spectrometer . . . ", Rev. Sci. Instr., vol. 35, 1964, pp. 88–95.

Bakker, J. M., "A New Mass Spectrometer/Mass Spectrograph", Int. J. Mass Spectrom. Ion Phys., vol. 11 (1973), pp. 305–307.

Curtis, C. C., Hsieh, K. C., Hudor, A. M., and Fan, C. Y., Ultramicroscopy, vol. 5 (1980), p. 244.

Chait, B. T., and Field, F. H., Int. J. Mass Spectrom. Ion Phys., vol. 41 (1981), pp. 17–29.

Ibid, vol. 65 (1985), pp. 169–181.

Holland, J. F., Enke, C. G., Allison, J., Stults, J. T., Pinkston, J. D., Newcome, B., Watson, J. T., "Mass Spectro . . . ", vol. 55 (1983), p. 997A.

Stults, J. T., Enke, C. G., and Holland, J. F., "Mass Spectrometry . . . ", Anal. Chem., vol. 55 (1983), pp. 1323–1330.

Della Negra, S. and Le Beyec, Y., "A $^{252}$Cf Time-of-Flight Mass . . . ", Int. J. Mass Spectrom. Ion Processes, vol. 63 (1984), pp. 21–29.

(List continued on next page.)

*Primary Examiner*—Bruce C. Anderson

*Attorney, Agent, or Firm*—Zarley, McKee, Thomte, Voorhees & Sease

[57] ABSTRACT

A means and method for single event time of flight mass spectrometry for analysis of specimen materials. The method of the invention includes pulsing an ion source imposing at least one pulsed ion onto the specimen to produce a corresponding emission of at least one electrically charged particle. The emitted particle is then dissociated into a charged ion component and an uncharged neutral component. The ion and neutral components are then detected. The time of flight of the components are recorded and can be used to analyze the predecessor of the components, and therefore the specimen material. When more than one ion particle is emitted from the specimen per single ion impact, the single event time of flight mass spectrometer described here furnishes specific information regarding the tendency for certain ions to be created jointly as opposed to random creation of the emitted particles. The means of the invention utilizes pulsed ion source means, dissociation means, detector means for accomplishing the method steps. The intensity of the pulsed ion source is controllable so that each pulse is limited to a small number of ions. In the preferred embodiment, the average number of ions per pulse is between 0 and 1, and preferably 0.5.

30 Claims, 4 Drawing Sheets

OTHER PUBLICATIONS

Della Negra, S. and Le Beyec, Y. in "Ion Formation from Organic Solids . . . ", p. 43, Ed. A. Benninghoven, Proc., 3rd Intl. Conf., Munster, Sep. 16–18, 1985, Springer–Verlag, New York, 1986.
Ibid, p. 165.
Della Negra, S. and Le Beyec, Y., "New Method for Metastable Ion . . . ", Anal. Chem., vol. 57 (1985), pp. 2035–2040.
Della Negra, S., Le Beyec, Y. and Hakansson, P., "Spontaneous Desorption Time–of–Flight Mass . . . ", Nucl. Instr. Meth. Phys., B9(85), pp. 103–106.
Della Negra, S., Deprun, C. et al., "On The Mechanism of Ion Formation In Spontaneous . . . ", Int. J. Mass Spectrom. Ion Processes, 75(87), 319.
Standing, K. et al., in "Ion Formation from . . . ", p. 37, ed. A. Benninghoven, Proc., 3rd Intl. Conf., Munster, Sep. 16–18, 1985, Springer–Verlag, New York, 1986.
Ens, W. et al., in "Secondary Ion Mass . . . ", p. 185, Proc. 5th Intl. Conf., Washington, D.C., Sep. 30–Oct. 4, 1985, Springer–Verlag, 1986.
Ens, W. et al., Ibid., p. 57.
Standing, K. G. et al., "Secondary Ion Time–of–Flight . . . ", Anal. Instrum., vol. 16 (1987), pp. 173–189.
Armenante, M. et al, "Ion Counting Technique . . . ", Inst. Phys. Conf. Ser. No. 84 (1986), pp. 337–338.
Wood, R. M. et al., "Time–of–Flight Energy Spectrometer for Positive Ions", Rev. Sci. Instrum., vol. 47, No. 12, Dec. 1976, pp. 1471–1474.

GENERAL FLOW CHART FOR DETERMINING CORRELATIONS OF MASS WITH STRUCTURE FROM RAW DATA

LEGEND:

ND = # OF HITS ON NEUTRAL DETECTOR FOR EACH SCAN

NI = # OF HITS ON ION DETECTOR FOR EACH SCAN

SINGLE EVENT MASS SPECTROMETRY

This invention was made with Government support under Contract No. W-7405-ENG82 awarded by the Department of Energy. The Government has certain rights in the invention.

BACKGROUND OF THE INVENTION a. Field of the Invention

This invention relates to a means and method of mass spectrometry, and in particular, a means and method of single event time-of-flight mass spectrometry for analysis of a specimen material.

b. Problems in the Art

The benefits, needs, and desires of determining the constituent make-up of compositions and materials is well known in the art. A number of different methods and instrumentation set-ups are used to attempt to analyze materials. In general these methods are either unreliable, marginally accurate, extremely costly, or require significant amounts of time for gathering of data from the instrumentation and/or scientific manpower for interpretation of results.

One method which is fairly accurate and reliable, but costly and time consuming, is mass spectrometry. The cost and time requirements of most mass spectrometers are prohibitive for small or economical applications.

One well known type of mass spectrometry is time-of-flight mass spectrometry. With this method ions are created in packets which are accelerated, drift through a space where the masses with different velocities are separated, and then detected. One of the methods for creating the packets of ions is by bombarding a solid specimen with a pulse of ions. In turn, charged ion particles are emitted directly from the solid specimen as packets of ions which are subsequently accelerated, separated and detected. The time-of-flight from their emission-to-detection is then utilized to compute their mass, which thereafter can be converted to a determination of the composition of the particle, and thus the composition of the specimen.

Mass spectrometers used for determining the constituent make-up of solid specimens can cost in the range of one-half million dollars. Time-of-flight mass spectrometers used for these purposes cost in the range of $300,000, and to date have not had high mass resolution.

There is therefore a real need for a mass-determining analytical method and instrumentation which can be used for a variety of types of specimens, including those with high mass compositions, which is simple in design, which takes significantly less time for information gathering, and which is significantly less costly than present systems.

It is therefore a primary object of the present invention to present a means and method of single event time-of-flight mass spectrometry which solves or improves over the problems and deficiencies in the art.

Another object of the present invention is to obtain factual information which accurately defines the structure of a specimen, the type of information not currently available to date by mass spectrometers.

Another object of the present invention is to provide a means and method as above described which has increased resolution, dynamic range, and accuracy over conventional mass spectrometry methods.

A further object of the present invention is to provide a means and method as above described which is significantly less costly than other mass spectrometry methods.

A further object of the present invention is to provide a means and method as above described which requires significantly less time to produce useful results.

Another object of the present invention is to provide a means and method as above described which uses conventional equipment, and is economical, reliable, and efficient.

These and other objects, features, and advantages of the present invention will become more apparent with reference to the accompanying specification and claims.

SUMMARY OF THE INVENTION

The present invention utilizes a pulsed source of ions wherein the number of ions produced is purposely limited to a very small number, with many of the pulses containing no ions. The purpose of producing very few ions is twofold. First, when only a few ions are produced in the source, the observation of the tendency for (or against) co-production of specific ions can be greatly enhanced. This tendency may be due to spatial orientation in the specimen of the co-produced ions, actual chemical bonding in the specimen of the co-produced ions, or to special conditions of ion production favoring co-production. Secondly, after acceleration of only a few ions (and especially when one ion is accelerated), the present invention provides a means for dissociation of the charged particles into one or more neutral and one or more ionic fragments. Generally, dissociation is induced in a dissociation cell. The mass of these fragments is then determined by time-of-flight measurements.

To enhance measurements (the observation of the co-produced ions) for fulfilling the first purpose, the inducement of dissociation of the accelerated particles may be turned off. However, both purposes can be fulfilled by operation of the dissociation cell at all times.

The pulsed ion source has a controllable intensity. In the preferred embodiment, the intensity is best reduced by limiting the spatial area of excitation to the specimen. One of the best means of accomplishing this localized ion production in the specimen is by projectile bombardment of the specimen where the projectiles are themselves charged ion particles. Hereafter, the projectile particles will be called the primary ion projectiles. The ion particles produced from the specimen due to its bombardment by the projectiles will be called secondary specimen ions.

The production of the secondary ions from the specimen by a single projectile is called herein a "single event". In the preferred embodiment, the average number of projectiles per pulse is between 0 and 1 and on the order of 0.5. Therefore, on an average, each projectile fired produces one event, namely the emission of one or more ions (secondary specimen ions) from a very localized area of the specimen, i.e., the area excited by an ion projectile of, for example, a $Cs^{+1}$ ion is very small.

After acceleration of the secondary ions, they enter a region wherein each ionic particle may be induced to dissociate. Undissociated ion particles, or ion and neutral fragments from each dissociated ionic particle, then traverse a field-free region prior to entering a detector which measures the time of arrival for each particle.

The invention differs from conventional time-of-flight mass spectrometry in three respects. It controls and limits intensity of the pulsed primary ion projectile source to a very small number, near zero. Likewise, a very small number of secondary ions are produced from the specimen per pulse, thereby maximizing the probability for "single events". Conversely, conventional mass spectrometry maximizes the signal of the primary pulsed ions, many times having thousands of ions per pulse which create thousands of secondary ion particles emitted from the specimen.

Secondly, conventional mass spectrometry attempts to minimize separation or fragmentation of the emitted secondary ion particles which possess the same mass. The present invention attempts, in one embodiment, to maximize fragmentation, ideally fragmenting every secondary ion particle or "event" into an ion component and a neutral component.

Thirdly, the present invention seeks to record each individual event or secondary ion particle and/or components, whereas conventional mass spectrometry records a composite "multiple-event" of the hundreds or thousands of emitted secondary ion particles.

The present invention allows the use of computing equipment to store and subsequently utilize each individual event or record which provides an immense amount of specific information not possible with conventional mass spectrometry. The invention also allows the use of computing equipment for forming a composite histogram of the single events to compose a much more accurate mass spectogram.

DETAILED DESCRIPTION OF THE PREFERRED EMBODIMENT

Figure 1:
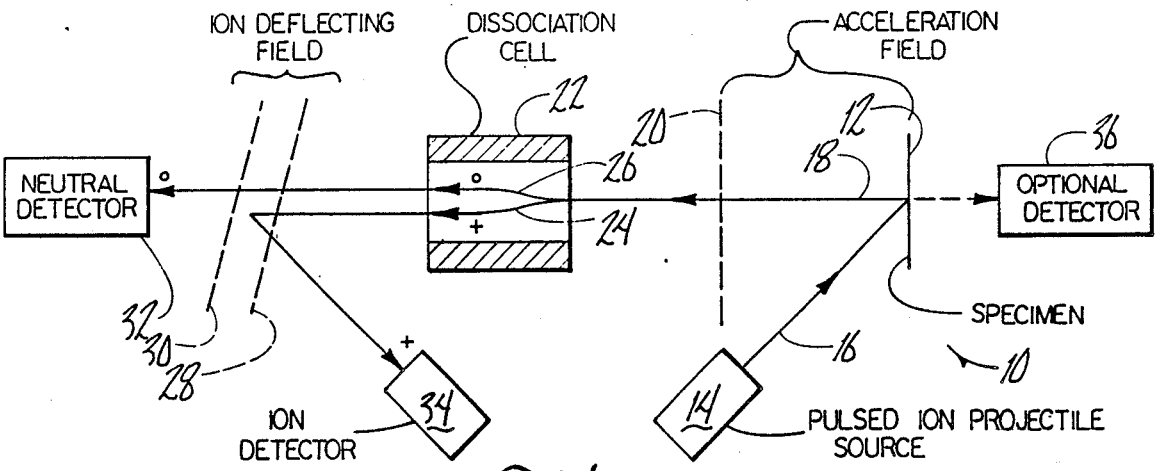
FIG. 1 is a schematic view of one embodiment of the invention.

With reference to the drawings, and particularly FIG. 1, there is shown a single event time-of-flight mass spectrometry system 10 according to the present invention. A specimen material 12 is positioned in the path of a projectile source, such as pulsed ion projectile source 14. The projectile source can theoretically be any focused energy, including but not limited to, pulsed ions, atoms, electrons, photons and ultrasound. Pulsed ion source 14 is controllable in intensity so that each pulse of ions (represented by line 16 and otherwise referred to as primary ion projectiles or primary ions) is limited to a very small number. In the preferred embodiment, each pulse contains on the average between 0 and 1 primary ions, and preferably, an average of 0.5 primary ions.

As is known in the art, a primary ion from pulsed ion source 14, upon striking specimen 12, creates a very limited number of emitted particles (represented by line 18 and otherwise referred to as secondary specimen ions or secondary ions or specimen ions). Each emitted secondary ion 18 is generally an ion carrying a single or a double electronic charge. Neutral particles are also emitted which may be subsequently ionized by various means if desired and thus would become secondary specimen ions. An electrical grid 20 is oppositely charged from the secondary ion(s) 18 and serves to accelerate secondary ion(s) 18 through grid 20 along line 18. The initial accelerating voltage can be, for example, 2000 volts.

Secondary ion(s) 18 then enter a dissociation cell 22 where secondary ion(s) 18 is/are separated, fragmented or dissociated into charged ion component(s) and uncharged neutral component(s) (ion and neutral components are represented by lines 24 and 26, respectively). Dissociation cell 22 can be, for example, a collision activated dissociation (CAD) cell, a collision induced dissociation (CID) cell, or the like, such as are known in the art.

After traversing a field-free region, electrical grids 28 and 30 are then presented to components 24 and 26 to create an ion deflecting field. Grids 28 and 30 are slanted with respect to the path of travel of components 24 and 26. It is to be understood that the voltage of the ion deflecting field should be greater than or equal to the accelerating voltage.

Each neutral component 26 of a secondary ion 18 is uneffected by the charged grids 28 and 30 and passes directly to neutral detector 32. On the other hand, grid 30 is charged so as to repel ion component 24, and serves to deflect ion component 24 at generally an angle equal to the angle of incidence of ion component 24. Ion component 24 is then detected by ion detector 34. The detectors 32 and 34 are conventional particle detectors, such as microchannel plate detectors known in the art.

It can therefore be seen that by limiting the intensity of pulsed ion source 14 to an average of one primary ion per pulse or "event", each secondary ion 18 continues the "event" and allows detection of the ion and neutral components 24 and 26 for that "event". If the secondary ion 18 consists of more than one ion, the resulting ions and neutral particles detected at 32 and 34 contain special information regarding the specimen since the emitted secondary ions will have been created from a very small region of the specimen, i.e., the effective diameter of the bombarding primary ion projectile 16. By using conventional time-of-flight analysis, the mass of the predecessor secondary ion 18 can be found for ion and neutral components 24 and 26. System 10 differs from conventional time-of-flight mass spectrometry in that it isolates and, in fact, maximizes the single events rather than having thousands of primary ions and associated secondary ions from each pulse of the ion source.

Optionally, a third detector 36 can be positioned so as to detect any secondary emission from specimen 12 when a secondary ion 18 is created. This would be one way to allow system 10 to record the exact time of emission of secondary ion 18.

The arrangement of system 10 enables simpler and cheaper instrumentation for time-of-flight mass spectrometer functions. It does not require high intensity pulsed ion sources, or high magnetic and electrical fields. It allows for better resolution and easier interpretation of data. It also is generally unlimited in its use, particularly being able to be used with high mass materials or complex compositions.

Because it records "single events", there is no loss of information, or scrambling or masking of information. System 10 allows better resolution and also has a beneficial result of keeping time records of each event, which can then be correlated to produce a map of the structure required to yield the particular ion and neutral pairs recorded. A histogram which simulates the conventional spectrogram of conventional mass spectrometers can be produced if desired by summing the individual events with any particular time resolution desired.

Utilization of system 10 allows detailed interpretation of results in as short a period as one-half hour, compared to what previously might have taken several man-days. Its simple design and equipment reduce costs of system 10 from one half million dollars for conventional systems such as MS/MS mass spectrometry to approximately One Hundred Fifty Thousand Dollars.

An "event" is defined as the evolution of a molecular formulation (or a fraction of a molecular formulation, or the evolution of closely associated formulations from the same bombarding primary ion) as a secondary ion(s) and a subsequent fragmentation of that compound formulation(s) into smaller component formulations. By direct comparison, the present invention creates, records, and analyzes single events, whereas conventional time-of-flight mass spectrometry concurrently creates, records, and analyzes many events; typically greater than 1000 events at one time. These results are averaged, which of necessity means information is lost.

System 10 detects and records each single event separately which includes simultaneous measurement of the molecular compound formulation and the fragment formulations. System 10 greatly increases sensitivity of measurement when specimen material can be kept stable between ion production events, and it permits derivation of structural information on complex compounds such as high mass peptides when performing such processes as amino acid sequencing.

The single-event time-of-flight mass spectrometry of system 10 is made possible by reducing the intensity of ion source 14 so that the statistical average of primary ions per pulse is on the order of 0.5. It has been determined that when this is achieved, 62% of the time 0 primary ions are contained in the pulse produced; 35% of the time 1 ion is contained in the pulse; 8% of the time 2 ions are contained in the pulse; 1.5% of the time 3 ions are contained; and .2% of the time 4 or more ions are contained. This statistically accounted for when analyzing the results of system 10.

Figure 2:
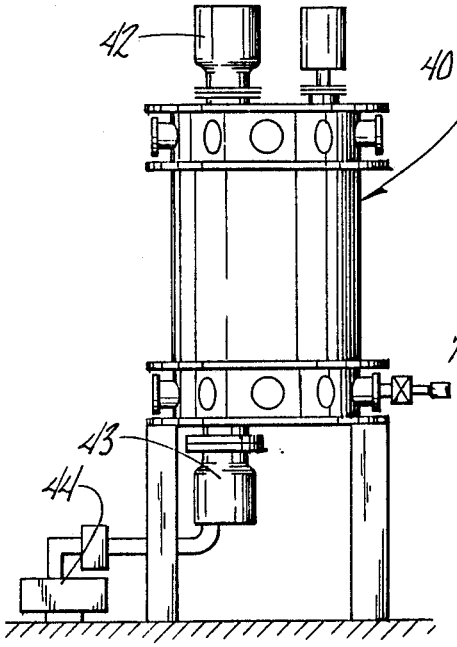
FIG. 2 is a side elevational schematic view of the structure of parts of a specific embodiment of the invention.
Figure 4:
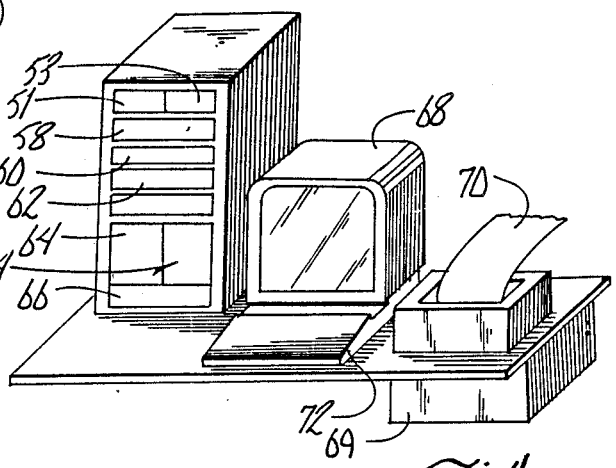
FIG. 4 is a schematic of the data computing mechanisms for an embodiment of the invention.
Figure 3:
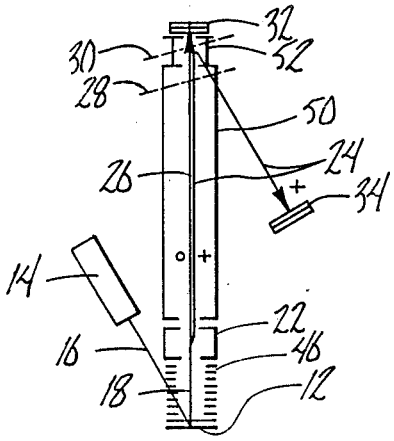
FIG. 3 is a schematic view of the interior components of the embodiment of FIG. 2.

By referring to FIGS. 2–4, actual components of an embodiment of the system according to the present invention are depicted. A vacuum chamber 40 is made of 12" diameter aluminum tubing with ½" walls and is sealed at both ends. A vacuum system comprised of vacuum pumps 42 and 43 and oil vacuum apparatus 44, with components well known in the art, are operable to create the vacuum in vacuum chamber 40. Vacuum pumps 42 and 43 can be made by Lester (for example model number 80L/S turbo pumps) while oil vacuum apparatus 44 can also be made by Lester and have a 7.CFM, 2 stage forepump (½ horsepower) and oil vacuum drive #MMA-100 with mist trap. A high frequency amplifier 41 (e.g., Photochemical Research Associates, Model 1763) is operatively positioned on vacuum chamber 40.

FIG. 3 schematically depicts the interior components of vacuum chamber 40. An ion gun firing unit or pulsed ion source 14 (e.g., Kimbal Physics, model number IGS-4), is aimed at specimen material 12 which is configured in a thin film held by appropriate supporting structure. Accelerator 46, comprised of Electromesh grids made by Buckbee Mears, leads to collision activated dissociation (CAD) cell 22, such as are known in the art. A transit region 50 exists until the ion reflecting field 52, which is transparent to the neutral components but effects the flight path of the ion components. Finally, detector 32 detects the arrival of the neutral component(s) and detector 34 detects the ion component(s) and can be fast detectors made by Galelio, Model FTD 2001.

FIG. 4 shows typical components used for compilation, detection, recording, and analysis of information derived from the single event time-of-flight spectrometer. Two Bertan model 205A-30P,N,R 30KV power supplies (reference numerals 58 and 60) are utilized, as is a Bertan model 205A-03R 3KV power supply (reference numeral 62). A LeCroy number 4208 time interval meter (1 nsec time accuracy) and Northwest Scientific Instrument time gate module (reference numerals 64 and 66, respectively), are utilized with a Hewlett-Packard Vectra 45.HP #72445A computer (reference numeral 68) having an 8 MHz processor, 640 kb RAM, with a 1.2 Mb 5¼" floppy disc port. In the preferred embodiment, computer 68 also includes a 40 Mb hard disc with 1 Mb expansion (reference numeral 69), a printer 70 and appropriate software 72. Appropriate interfacing apparatus 74 is also present in the system. The equipment shown in FIG. 4 can also include an ion gauge and tube 51, and can have the high voltage deflector circuitry 53.

Operation of the invention with regard to amino acid sequencing will be described below, with primary reference to the embodiment shown in the schematic of FIG. 3. A source of pulsed primary ions 16, called the primary beam (or fast atom bombardment), imposed upon a solid specimen 12 produces very high mass emitted secondary ions 18 from biological structures. In conventional instruments, the primary beam current must be high enough to allow high sensitivity, but this must also be balanced against specimen loss, damage and charge build-up. In the operation of this invention, the primary beam current will be about 100,000 times lower in intensity than a conventional primary beam current. Because of the low current level, a Cs (Cesium) ion gun (pulsed ion source 14) can be powered with a battery floated at the gun accelerating voltage.

The secondary beam 18 of molecular ions will be produced at about 100,000 times lower intensity than needed for conventional mass spectrometry. After acceleration by accelerator 46, the secondary ion beam will traverse a region where each molecular ion will be fragmented in the CAD or dissociation cell 22 into neutral and ion components 24 and 26. The fragments 24 and 26 continue at the same velocity and direction as the precursor molecular secondary ion 18 but have a small velocity shift distributed by a conservation of momentum between ion and neutral fragments 24 and 26. This shift is caused by the energy associated with dissociation of molecular secondary ion 18.

The conservation of momentum and the velocity of the primary beam associated with the fragments provides the basis for later determination of exact mass relationships of the primary particle and the fragments which evolve from the singular, molecular event.

After dissociation and transit through region 50, components 24 and 26 enter an electrostatic field or deflecting field 52. The neutral component 26 continues unaffected and activates the detector 32 whose signal is recorded as a time interval relative to the time at which the pulsed ion(s) reached the specimen. The time of arrival of the neutral fragment 26 is stored in a buffer. The ion component 24 is reflected by electrostatic field 52 and travels toward and activates the ion detector 34. The time of arrival of the ion fragment is also stored in a buffer.

The crucial measurement to this invention is the time difference between arrival of the neutral fragment 26 and its related ion fragment 24. This time can be optimized by appropriate choice of ion fragment transit distance after reflection. The typical time difference will be 10 microseconds which can be measured with commercially available electronic equipment limitations of 156 picoseconds. The computer will be set up to store 1,000,000 such fragmentations as individual records.

Figure 5:
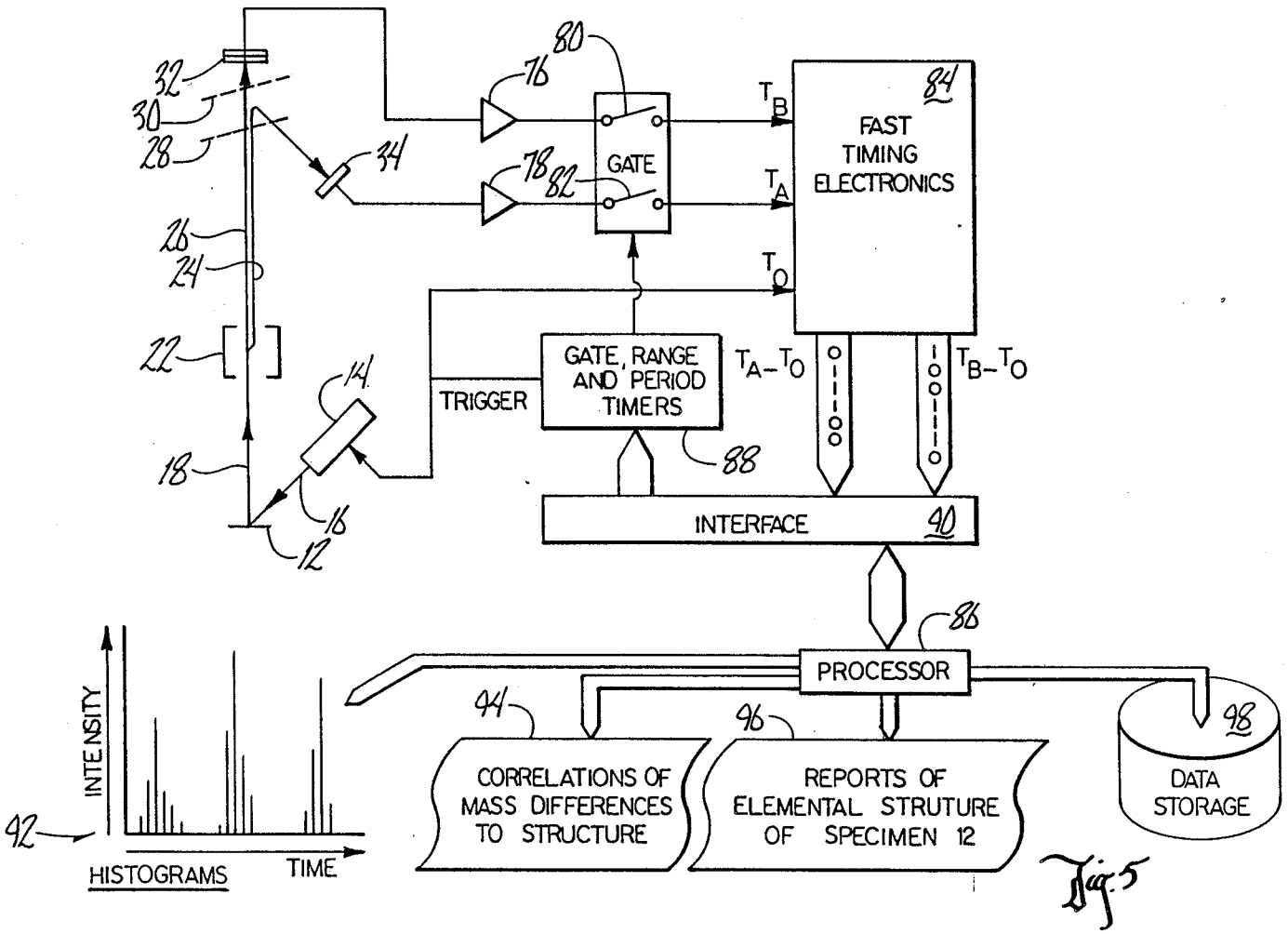
FIG. 5 is a schematic view of an embodiment of the invention including schematics of the timing, controlling, and data acquisition systems of one embodiment of the invention.

From this information the elemental structure of a complex organic compound such as the amino acid sequence in a peptide can be determined without the confusion present in mass spectra where the average results of all the fragmentations have to be deciphered. Here each molecular structure can be associated with a particular set of fragments, thus pinpointing where the molecule was "snipped apart". The mass spectrum is formed by a combination of singular molecular events which are all recorded separately. The recording of data will require approximately 17 minutes. Subsequent computer interpretation and display will also require an additional 13 minutes. FIG. 5 is a schematic representation of an embodiment of the invention similar to that shown in FIGS. 1 and 3. Additionally, FIG. 5 schematically depicts one embodiment of a timing, control, and data processing system which could be utilized. The signals from detectors 32 and 34 could be sent through electric conduits to amplifiers 76 and 78 which in turn are electronically connected to a gating device having gates 80 and 82, which are basically switches which are in electric communication with the fast timing electronics of a time interval device 84. The signals received from ion detector 34 through amp 78 and gate 82 are designated as $T_A$ whereas the signals received from neutral detector 32 through amp 76 and gate 80 are designated as $T_B$.

A processor 86 controls operation of the entire system depicted in FIG. 5. It is interfaced to time interval device 84 and gate, range and period timers 88 by an interface 90. As can be seen, gate, range and period timers 88 are in electrical communication with both ion firing gun 14 and gates 80 and 82, in addition to time interval device 84. Gate, range and period timers 88, upon instruction from processor 86, send a trigger signal to ion firing gun 14 and time interval device 84 simultaneously. This signal is referred to as $T_0$ and provides a starting time upon which subsequent detection of neutral and ion components of that event are detected as $T_A$ and $T_B$. Gate, range, period timers 88 therefore also control operation of gates 80 and 82 to allow the signals to reach the time interval device 84.

FIG. 5 also depicts that time interval device 84 computes the time of flight of the neutral and ion components emanating from the triggered ion firing gun 14 pulse by subtracting $T_A$ from $T_0$, and subtracting $T_B$ from $T_0$. Time interval device 84 converts the analog detection signals of $T_B$ and $T_A$ into digital signals which can then be communicated through interface 90 to processor 86.

The system of FIG. 5 can therefore, depending on software, be operated to trigger numerous ion firing gun 14 pulses, to time and gate the detection of the ion and neutral fragments resulting from those pulses, and collect and compute the time-of-flight data of those fragments for analysis. In the embodiment of FIG. 5, the processor 86 can be connected to a plurality of different analytical devices, and can be used for a plurality of different analytical outputs. As shown, the data from numerous ion pulses, and correlated timings, can be gathered and stored by the processor. These individual event-in-time records can then be operated upon, and compiled to create histograms, which is schematically depicted by histogram 92 in FIG. 5. The histogram would be a record of the various timed events plotted according to time.

The software can also be constructed to compute correlations of mass-differences-to-structure as is shown in box 94. It can also produce reports of elemental structure of the specimen 12 as is depicted in box 96. Cylinder 98 depicts data storage capability of the invention, which as discussed above, should be able to easily store at least one million records, each record containing information such as identification of a triggered pulse and the resulting timing data corresponding to the pulse.

Figure 6:
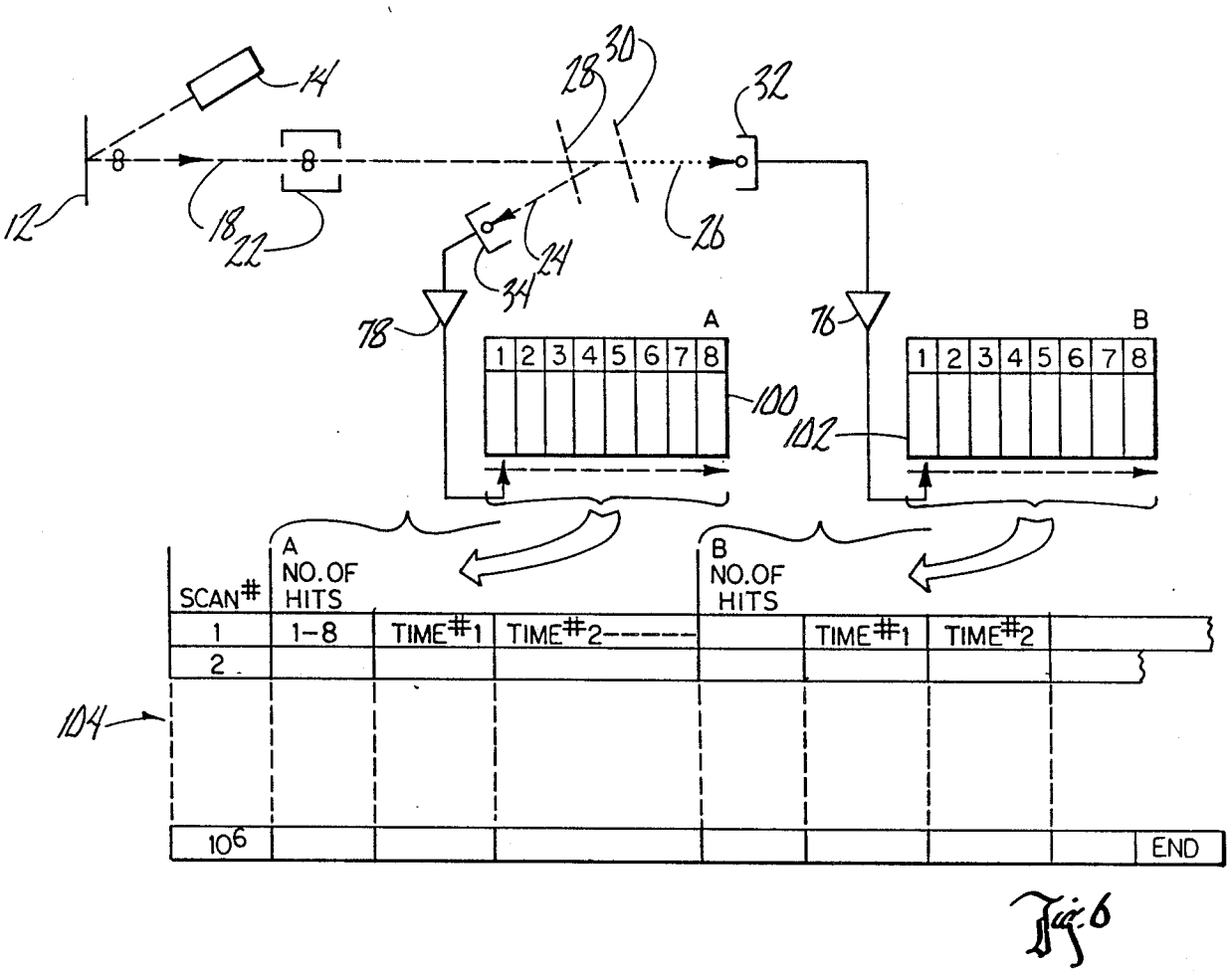
FIG. 6 is a schematic of an embodiment of the invention depicting storage of the events of the system.

FIG. 6 again depicts schematically the basic time-of-flight system of FIGS. 1 and 3, but additionally schematically depicts one embodiment of a system of storing data gathered by the invention. The fast timing electronics 84 (FIG. 5), for each timing sweep based on the trigger pulse from ion firing gun 14, would time and then send through interface 90 to the processor 86 and data storage 98, a record of the number of detections or "hits" experienced by neutral detector 32 and ion detector 34, respectively. In the set-up shown in FIG. 6, the system is prepared to record and store up to eight hits per detector. Box 100 represents schematically data storage for up to eight detections or hits for ion detector 34, whereas box 102 does the same for detections or hits from neutral detector 32. Basically, the set-up is for two channels, the first channel being A, and the second channel being B; those channels corresponding to timing signals $T_A$ and $T_B$.

Fast timing electronics 84 would also capture, compute, and send to processor 86 and data storage 98 the corresponding time interval between $T_0$ and detection of the various hits. Matrix 104 schematically depicts that for each scan, there would be stored the total number of hits per channels A and B, and then the time interval between the detection or hit and $T_0$ would be stored for each of those hits. As previously mentioned, it has been determined that for each experiment, data storage 98 should be able to handle up to $10^6$ similar records for each of the scans.

Figure 7:
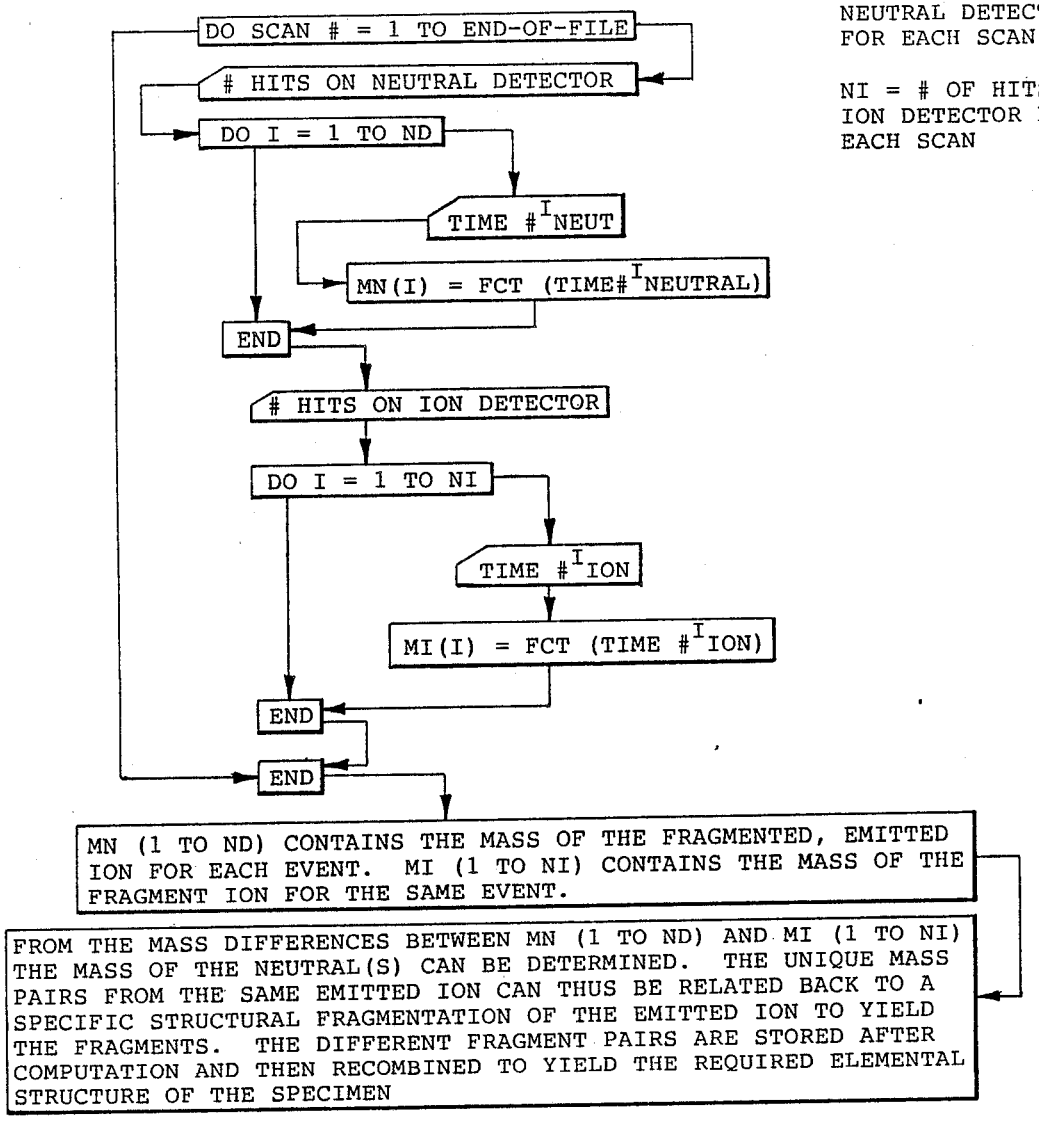
FIG. 7 is a schematic of the flow chart for one embodiment of determining correlations of mass with structure from raw data of the system.

To further assist in an understanding of how the information from the time-of-flight instrument can be processed and analyzed, FIG. 7 sets forth a general flow chart for determining correlations of mass with structure from the raw data obtained. The rectangular boxes in the flow chart represent operational steps, whereas the rectangular boxes with the upper lefthand corner cut off represent input steps.

In this operational sequence, the data regarding the number of detections or hits for each scan regarding neutral and ion particle fragments, and their corresponding time of detection compared with $T_0$, are operated upon to determine the mass of each of the fragmented ion or neutral particles. These derived fragment masses, with the time interval information, can be then operated upon to derive the elemental structure of specimen 12.

It can therefore be seen that the invention accomplishes at least all of its stated objectives.

The included preferred embodiment is given by way of example only, and not by way of limitation to the invention, which is solely described by the claims herein. Variations obvious to one skilled in the art will be included within the invention defined by the claims.

It is to be understood that the present invention is a system for permitting the histogramming and correlation of timed events from individual sweeps in a time-of-flight mass spectrometer. In one of the preferred embodiments, the system will have one nanosecond (ns) ($1\times10^{-9}$ seconds) time accuracy in recording time-of-arrival of a minimum of eight events with a dead time of less than five ns ($5\times10^{-9}$ seconds) with a 250 microsecond ($\mu$sec.) ($250\times10^{-6}$ seconds) period. The repetition rate for recurrent scan (events in the specimen) periods should be equal to or greater than 1000 hertz (Hz). The system therefore will allow for accumulation of 1,000,000 ($10^6$) periods from a single experiment of 17 minutes. The system can also allow for programmable alteration of minimum and maximum time windows for blanking out sections of sweep times which are not desired. The time resolution of these windows should be less than 50 ns ($50\times10^{-9}$ seconds). It is further to be understood that the system can be integrated with standard equipment and components which can then be integrated with a standard central processor.

It is also to be understood that the experimenter can input $T_0$ into the system, and also can input the width of the time window (from 10 to 250 microseconds).

Further, to understand the general principles surrounding time-of-flight mass spectrometry, and mass spectrometry in general, the following articles contain descriptions to aid in such an understanding, and are listed below and incorporated by reference hereto:

Turko, B. T., MacFarlane, R. D., and McNeal, C. J., Int. J. Mass Spectrom Ion Phy. 53 (1983) 353–362. "$^{252}$Cf-Plasma Desorption Mass Spectrometry Multistop Time Digitizer".

MacFarland, R. D., Anal. Chem. 59 (1983) 1247A–1264A. "Californium—252 Plasma Desorption Mass Spectrometry. Large Molecules, Software and Essence of Time".

Chait, B. T., and Standing, K. G., Int. J. Mass Spectrom. Ion Phy. 40 (1981) 185–193. "A Time-of-Flight Mass Spectrometer for Measurement of Secondary Mass Spectra".

Ens, W., Standing, K. G., Westmore, J. B., Oglilvie, K. K. and Nemer, M. J., Anal. Chem. 54 (1982) 960–966. "Secondary Ion Mass Spectrometry of Protected Diribonucleoside Monophosphates with a Time-of-Flight Mass Spectrometer".

Benninghoven, A., "Secondary Ion Mass Spectrometry of Organic Compounds" (Review) p. 65–89 in "Ion Formation from Organic Solids". Proc. of 2nd Intl. Conf., Munster, F.D.R. September 1982. Ed. A. Benninghoven, Springer-Verlag, Berlin, 1983.

Della-Negra, S. and Le Beyec, Y., Anal. Chem. 57 (1985) 2035–2040. "New Method for Metastable Ion Studies with a Time-of-Flight Mass Spectrometer. Future Applications to Molecular Stucture Determinations".

Biemann, K., Anal. Chem. 58 (1986) 1288A–1300A. "Mass Spectrometric Methods for Protein Sequencing".

Additionally, the following United States Patents also contain general information regarding mass spectrometry and time-of-flight ion mass analyzation, and are incorporated by reference hereto:

| U.S. Pat. No. | Inventor | Issued |
|---|---|---|
| 4,611,118 | Managadze | 9-9-86 |
| 4,472,631 | Enke, et al. | 9-18-84 |
| 4,072,862 | Mamyrin et al. | 2-7-78 |
| 4,458,149 | Muga | 7-3-84 |

It is to be further understood that measurements according to the present invention to observe the tendency for or against co-production of specific secondary ions can be enhanced by operating the configuration depicted in FIG. 1 as described above except that dissociation cell 22 would be inactivated. No dissociation of the secondary ions would be induced, and the secondary ions would pass and be directed to ion detector 34 for time-of-flight measurement.

What is claimed is:

1. A single event time of flight mass spectrometer for analysis of a specimen material, the single event being the evolution of a molecular formulation from the same bombarding primary projectile into a secondary particle and subsequent fragmentation into component formulations, comprising:

pulsed projectile source means for imposing on the order of single pulsed primary projectiles on a small localized area on the specimen to induce a corresponding emission of on the order of single, temporally isolated secondary ion particles from the small, localized area, the intensity of the pulsed projectile source being controlled so that each pulse of the pulsed projectile source produces only a very small number, generally on the average between zero and one, of primary projectiles;

detector means for individually detecting and timing the arrival of the secondary particles.

2. The spectrometer of claim 1 further comprising acceleration field means for presenting an acceleration field to the specimen to cause any emitted secondary ion particle to accelerate through the field.

3. The spectrometer of claim 2 wherein the acceleration field means comprises an electrical grid means for attracting and accelerating any emitted secondary ion particle from the specimen.

4. The spectrometer of claim 2 wherein a dissociation means receives predominantly single, temporally isolated secondary ion particles from the specimen after accelerating through the acceleration field of the acceleration field means.

5. The spectrometer of claim 4 wherein the dissociation means receives secondary ion particles from the set comprising one, two and three secondary ion particles, any and all of which being isolated in time for each primary projectile, each temporally isolated secondary ion particle being dissociated into an ion and neutral components so as to yield exclusive identification and correlation of secondary ion particles with corresponding ion and neutral components.

6. The spectrometer of claim 1 wherein the pulsed projectile source means is a pulsed ion source.

7. The spectrometer of claim 5 wherein the pulsed ion source is controllable in intensity so as to produce predominantly a single primary projectile per pulse.

8. The spectrometer of claim 1 wherein the pulsed projectile source means averages between 0 and 1 projectiles per pulse.

9. The spectrometer of claim 6 wherein the pulsed projectile source means averages approximately 0.5 projectiles per pulse, providing predominantly, within conventional statistical probability, single primary projectiles per pulse.

10. The spectrometer of claim 1 further comprising a dissociation means for receiving an emitted secondary ion particle from the specimen and dissociating the particle into at least one charge ion component and one uncharged neutral component.

11. The spectrometer of claim 10 further comprising detector means which measure the time of arrival of each individual ion component and each individual neutral component.

12. The spectrometer of claim 11 wherein the detector means comprises a first detector for measuring the time of arrival of the neutral component from a fragmented secondary ion accelerated from the specimen, and a second detector for measuring the time of arrival of the ion component of any emitted secondary ion particle of the specimen and/or the ion fragment component from dissociation of an emitted secondary ion from the specimen.

13. The spectrometer of claim 11 wherein the detector means includes repelling field means for causing ion components to be reflected from the general path of neutral components.

14. The spectrometer of claim 11 wherein the detector means detects the arrival of the ion and neutral components of any emitted secondary ion particle.

15. The spectrometer of claim 11 wherein the detector means includes means for recording the individual time of arrival of an ion or neutral component of any emitted ion particle.

16. The spectrometer of claim 11 wherein the detector means further comprises computer means for calculating the mass of any emitted secondary ion particle by utilizing information obtained from the detector means and particularly for measuring accurately differences in mass of co-emitted secondary ion particles, as well as from knowledge of the time of secondary ion emission from the specimen.

17. The spectrometer of claim 11 further comprising a third detector means operatively positioned in association with the specimen for detecting emission other than of secondary ions from the specimen for each primary pulsed projectile emission.

18. The spectrometer of claim 10 wherein the dissociation means comprises a cell means for fragmenting a secondary ion particle or particles of the specimen as they pass through the cell.

19. The spectrometer of claim 1 where the small, localized area is generally equal to the diameter of the primary projectile.

20. The spectrometer of claim 1 wherein the pulsed projectile source means is a pulsed atom source.

21. A method of single event time of flight mass spectrometry for analysis of a specimen material, the single event being the evolution of a molecular formulation from the same bombarding primary projectile into a secondary particle and subsequent fragmentation into component formulations, comprising the steps of:

pulsing a means of excitation upon the specimen to produce from a small, localized area of the specimen a corresponding approximately one, temporally isolated emitted secondary ion particle to the approximately one bombarding primary projectile pulsed from the means of excitation;

controlling the intensity of the means of excitation so that each pulse produces from the small, localized area of the specimen, with a high probability, one or two secondary ion particles;

detecting and timing the arrival of each emitted secondary ion particle.

22. The method of claim 21 further comprising inducing dissociation of the secondary specimen ion into at least one charged ion component and at least one uncharged neutral component.

23. The method of claim 22 comprising the further step of accelerating the emitted secondary ion particle after emission and before dissociation.

24. The method of claim 22 wherein any ion component and neutral component of any emitted particle is detected by separate detectors.

25. The method of claim 22 comprising the further step of recording information regarding detection of the ion and neutral components of any emitted particle.

26. The method of claim 22 comprising the further step of computing masses of the ion fragment component, the neutral fragment component, as well as the mass of the emitted particle utilizing information derived exclusively from detection of the ion and neutral components of the single, temporally isolated emitted particle.

27. The method of claim 21 wherein the pulsed means of excitation is a pulsed ion source, the intensity of which is controlled so as to produce predominantly a single primary projectile per pulse.

28. The method of claim 27 wherein the pulsed ion source is controlled to average between 0 and 1 primary projectile ions per pulse.

29. The method of claim 28 wherein the ion source is controlled to average approximately 0.5 primary projectiles per pulse, providing predominantly, within conventional statistical probability, single primary projectiles per pulse.

30. The method of claim 21 wherein more than one ion particle emitted per single ion impact provides very exact mass differences and can be correlated for the tendency for certain mass emitted particles to be created jointly due to a common precursor in the specimen or due to a common spatial residence in the specimen.

* * * * *